US005743208A

United States Patent [19]

Miller

[11] Patent Number: 5,743,208

[45] Date of Patent: Apr. 28, 1998

[54] TENSIONING DEVICE FOR BOAT COVER

[75] Inventor: Randolph F. Miller, Mt. Vernon, Wash.

[73] Assignee: Bayliner Marine Corporation, Everett, Wash.

[21] Appl. No.: 719,178

[22] Filed: Sep. 24, 1996

[51] Int. Cl.[6] ..... B63B 17/00

[52] U.S. Cl. ..... 114/361; 135/88.01; 135/123

[58] Field of Search ..... 135/142, 88.01, 135/88.13, 123, 127, 141; 114/361

[56] References Cited

U.S. PATENT DOCUMENTS

| | | | |
|---|---|---|---|
| 2,243,190 | 5/1941 | Capaldo | 403/378 |
| 3,025,866 | 3/1962 | Cockrum | 135/5 |
| 3,354,892 | 11/1967 | Frieder | 135/6 |
| 3,422,829 | 1/1969 | Adams, Jr. | 135/6 |
| 3,789,903 | 2/1974 | Clark et al. . | |
| 4,198,998 | 4/1980 | Duffy | 135/5 AT |
| 4,671,203 | 6/1987 | Sanburg | 114/361 |
| 4,719,954 | 1/1988 | Curtis et al. | 160/67 |
| 4,793,371 | 12/1988 | O'Ferrell et al. | 135/142 |
| 4,926,782 | 5/1990 | Lacy | 114/361 |
| 5,009,184 | 4/1991 | Voldrich | 114/361 |
| 5,303,667 | 4/1994 | Zirkelbach et al. | 114/361 |
| 5,413,063 | 5/1995 | King | 114/221 R |
| 5,479,872 | 1/1996 | Hulett | 114/361 |
| 5,522,409 | 6/1996 | May | 135/88.05 |
| 5,598,668 | 2/1997 | Isom | 135/142 |

*Primary Examiner*—Stephen Avila
*Attorney, Agent, or Firm*—Seed and Berry LLP

[57] ABSTRACT

A tubular sleeve has two spaced rows of holes with the holes of one row axially offset lengthwise of the row of holes and a horizontal slot at right angles to the rows of holes, the sleeve fitted telescopically over two axially aligned and spaced tubes that hold up a cover, each tube having detents that fit respectively into one of the holes of the rows of holes and into the slot so that the lengthwise spacing between the tubes can be adjusted by repositioning a detent into a different hole in a different row of the holes to adjust the tension against a cover to be held upright by the tubes.

8 Claims, 2 Drawing Sheets

TENSIONING DEVICE FOR BOAT COVER

TECHNICAL FIELD

This invention relates to tensioning of flexible boat covers that are held upright by sets of tubes fastened to the boat. The invention includes a sleeve that fits over two axially aligned tubes, to lengthen the relative length of the two tubes.

BACKGROUND OF THE INVENTION

Boat canvas, now made from synthetic fabrics, has been held upright and tensioned by a system of aluminum or stainless steel interconnected tubes. The tubes are connected to one another by slides that allow adjustment of one tube relative to another tube.

The correct tension in such a tube system is difficult to achieve because the tube system is designed for one geometry. While the slides allow for adjusting the position of the tubes, the geometry gets changed such that it undesirably affects the uniformity of the tension on the cover. If the tension is not uniform, the cover will undesirably sag in areas and collect water.

SUMMARY OF THE INVENTION

This invention provides for very small increments of adjustment in the distance spanned by two tubular members axially aligned with one another and held in alignment by a sleeve that is fitted over or within the tubes to support and tension a boat cover, such as, the cover over the open cockpit or flying bridge of a boat. The sleeve is uniquely provided with two spaced rows of holes spaced lengthwise, the holes of one row being offset axially and circumferentially on the sleeve, relative to the holes of the other row. The sleeve also has a slot at right angles to the rows. The tubes have fasteners, such as detents, that fit into the holes or the slot. To adjust the distance spanned by the axially aligned tubes, the sleeve is rotated to position another row over the detent and the tubes axially positioned to fit the detent into the hole of the other row.

The sleeve can be outside or inside of the tubes. The holes can be in the tubes and the detents on the sleeve.

DETAILED DESCRIPTION OF THE INVENTION

As mentioned above, the present invention is directed toward a structure for tensioning the cover over a boat open area such as a cockpit. The apparatus of this invention allows the user to tension the boat cover by incrementally adjusting in very small increments the axially aligned tubes which affix the cover to the boat.

Figure 1:
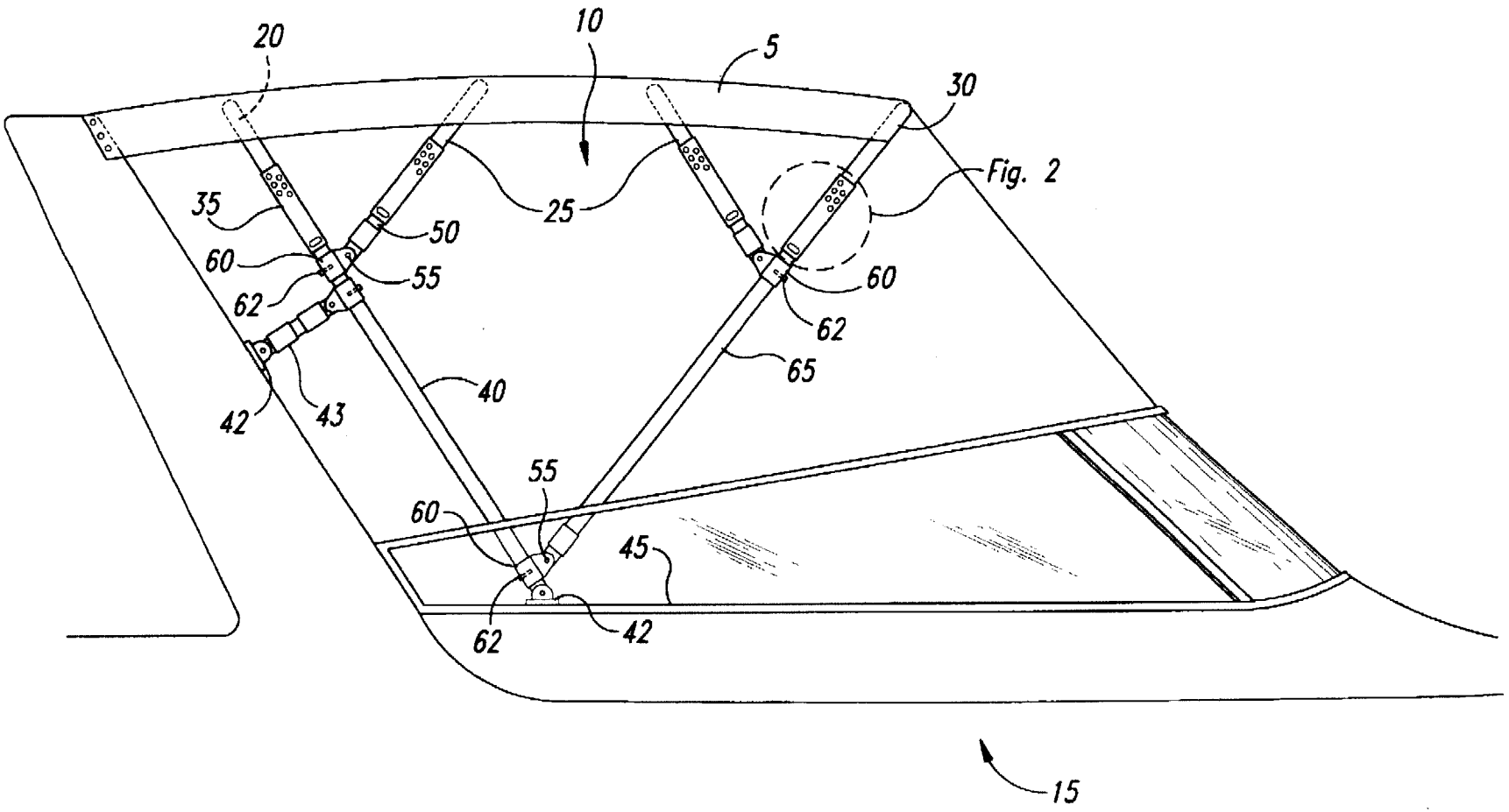
FIG. 1 is a side view of a representative fabric boat covering tensioner.
Figure 2:
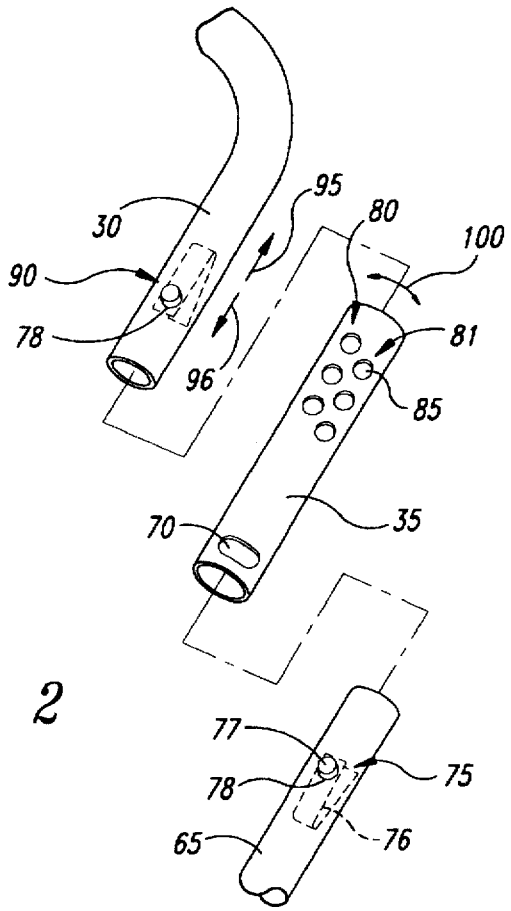
FIG. 2 is a detail of FIG. 1 illustrating the interrelationship between upper bow, adjustment tube and lower support tube.
Figure 3:
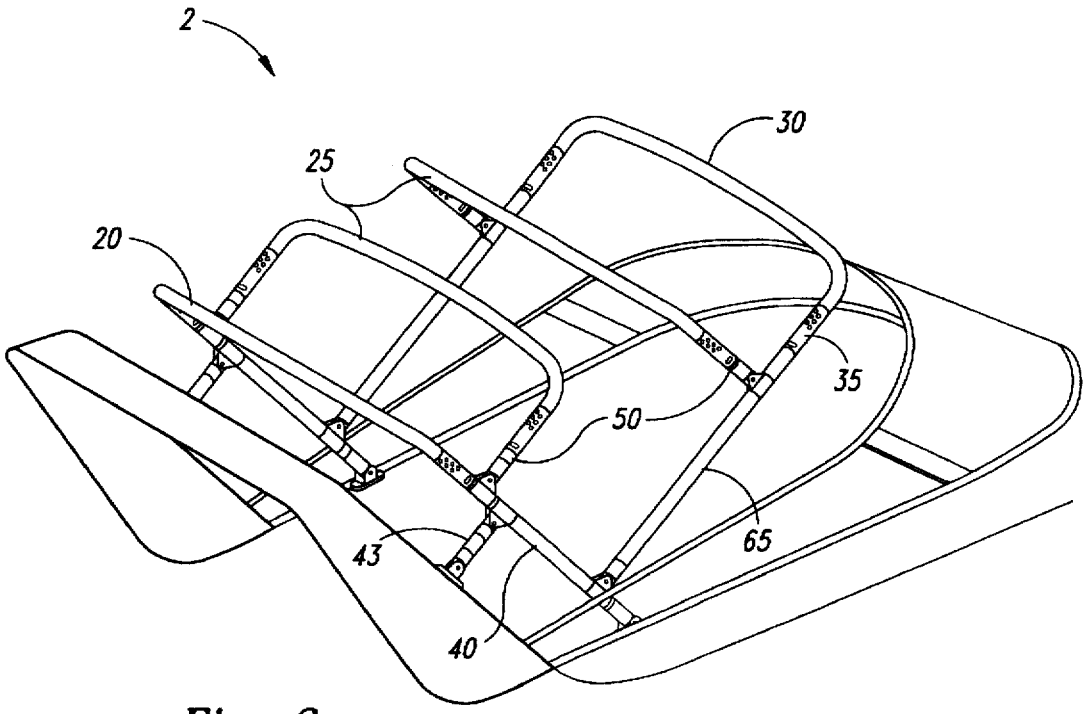
FIG. 3 is an isometric view of the adjustable fabric boat cover tensioner without the fabric cover installed.

A representative adjustable fabric cover tensioner 2 in accordance with the present invention is shown in the figures for purposes of illustration. As is shown in FIGS. 1 through 3, the cover 5 extends over an open area 10 of boat 15. The cover is supported by an aft upper bow 20, a mid upper bows

25 and a forward upper bow 30. The upper bows 20, 25 and 30 are curved slightly as shown to produce a side-to-side crown to the fabric and are positioned in height to produce a fore-aft crown also. The bows are attached by means of adjustment tubes or sleeves 35 to tubular aft lower support 40, mid lower supports 50 and forward lower support 65, respectively.

As is best seen in FIG. 1, the aft lower support 40 is pivotably attached to the boat surface 45 by pivot joints 42 and support 43. Mid lower supports 50 are attached by means of pivots 55 and sleeves 60 to the aft lower support 40 or the forward lower support 65. The sleeves 60 are adjustably fixed to the aft lower support 40 and forward lower support 65 by set screws 62. The pivot joints 55 and sleeves 60 permit motion of the mid lower supports 50 to partially increase or decrease tension in the cover 5. The forward lower support 65 is pivotally attached to the aft lower support 40 by means of pivot 55 and sleeve 60. The arrangement similarly permit the forward lower support 65 to move relative to the aft lower support 40 to increase or decrease tension in the cover 5 and permits collapse of the tensioner 2 for storage or for removal of the cover 5.

As is best seen in FIG. 2, adjustment tube 35 is slidable over forward upper bow 30 and forward lower support 65. A slot 70 in the adjustment tube engages a conventional spring pin 75 in the forward lower support 65. The adjustment tube contains two rows of holes 80 and 81 at its upper extremity. Each hole 85 is engageable with a conventional spring pin 90 in forward upper bow 30. A similar arrangement is provided for mid upper supports 25 and aft upper support 20, as shown in FIG. 1.

In operation, spring pin 90 projects through one of holes 85. To increase the tension in cover 5, the user depresses the spring pin 90 and directs forward upper bow 30 in an upward direction as is indicated by arrow 95 or a downward direction as indicated by arrow 96. When the desired tension is obtained, adjustment tube 35 is rotated as indicated by arrow 100 until one of holes 85 engages spring pin 90. As is seen from FIG. 2, slot 70 is sized such that adjustment tube 35 may be rotated to engage any of holes 85 in rows 80 or 81 with spring pin 90. The holes 85 of row 80 are staggered lengthwise from the holes 85 of row 81. Such placement maximizes the number of positions of forward upper bow 30 relative to forward lower support 65 without unduly compromising the structure of the adjustment tube. Although two rows 80 and 81 are shown in FIG. 2 as a preferred embodiment, an increased number of rows is possible to increase the number of available adjustment positions.

During use, aft upper bow 20 and mid upper bows 25 may be adjusted in a manner similar to that discussed above for adjustment of forward upper bow 30. Each of upper bows 20, 25 and 30 may be adjusted as indicated by arrows 95 and 96 to either increase or decrease the tension in cover 5. Because the adjustment of each of the upper bows moves the upper bows and the cover 5 in only one direction, tensioning of the cover 5 is simplified and the tendency for cover 5 to be overstretched in one region or understretched in another region is reduced.

As is seen in FIG. 2, spring pin 75 comprises spring 76 and button 77. The spring pin 75 is located in forward lower support 65 and forward upper bow 30 such that the button projects through spring pin hole 78. The tension of spring 76 keeps the spring pin 75 in a fixed position in toward lower tube 65.

As is best seen in FIG. 2, forward upper bow 30 may be easily removed completely from the forward lower support 65 for replacement or retrofitting. To remove the forward upper bow 30 from the forward lower support 65, spring pin 75 is depressed and adjustment tube 35 is slid in a downward direction. Spring pin 90 is then depressed, permitting the forward upper bow 30 to be slid upward as indicated by arrow 95 until it is disengaged from adjustment tube 35. Aft upper bow 20 and mid upper bows 25 may be disengaged in a similar manner.

As disclosed in the preferred embodiment, spring pin 75 is located in the forward upper bow 30 and forward lower support 65 while slot 70 and holes 85 are located in adjustment tube 35. However, other embodiments of this invention are possible. For instance, slot 70 and holes 85 may be located in either forward lower support 65 or forward upper bow 30 and spring pins 75 may be located in adjustment tube 35. However, for ease of manufacture and to minimize the potential cost for replacement of members containing slots and holes, the preferred embodiment is to have slots 70 and holes 85 located in adjustment tube 35.

I claim:

1. A tensioner for tightening a flexible boat covering, comprising:

a first tube having an axis;

a second tube axially aligned with the first tube; and a sleeve telescopically fitted between the first and second tubes, one of the first tube and the sleeve having a plurality of apertures, the other of the first tube and the sleeve having at least one detent for adjustably connecting the first tube to the sleeve, the apertures defining at least a first row lying substantially along the first tube axis and a second row adjacent to the first row, each aperture having a center, the centers of the apertures of the first row offset axially relative to the centers of the apertures of the second row such that the centers of the apertures of the first row are between the centers of the apertures of the second row, the detent engageable with the apertures to axially lock the first tube and the sleeve relative to one another, and means for fastening the second tube to the sleeve to lock the second tube axially to the sleeve, wherein the sleeve and the first tube can be positioned axially and locked in small increments relative to one another by engaging the detent with any aperture.

2. The tensioner of claim 1 wherein the tubes form part of a framework for covering the open area of a boat, the framework having an upper set of tubes to engage the covering of the boat, and the framework having a lower set of tubes fastened to the boat, and wherein there are a plurality of sleeves for connecting the tubes of the upper set of tubes with the tubes of the lower set of tubes so that the tubes of the upper set of tubes can be adjusted axially relative to the tubes of the lower set of tubes.

3. The tensioner of claim 1 wherein the sleeve has the two rows of apertures and the first tube has the detent.

4. The tensioner of claim 1 wherein the means for fastening the second tube to the sleeve comprises a slot in one of the second tube and the sleeve, the slot lying substantially perpendicular to the rows and a detent in the other of the second tube and the sleeve, the detent engageable with the slot so that the sleeve and the second tube can be rotated relative to one another while the detent engages the slot.

5. The tensioner of claim 2 wherein the sleeve has the two rows of apertures and the first tube has the detent.

6. The tensioner of claim 2 wherein the means for fastening the second tube to the sleeve includes a slot in one of the second tube and the sleeve, the slot lying substantially perpendicular to the rows and a detent on the other of the second tube and the sleeve, the detent engageable with the slot so that the sleeve and the tube can be rotated relative to one another while the detent engages the slot.

7. A tensioner for a boat covering that has a tubular framework for holding the covering above an open area of the boat, comprising:

a set of lower tubes fastened to the boat;

a set of upper tubes pressed against the cover to hold the cover upright;

a tubular sleeve telescopically fitted between the tubes of each of the upper and lower sets of tubes, the sleeves each having two rows of spaced framework adjusting apertures for adjusting the length of a combined set of upper and lower tubes, each of the apertures having a center, the apertures of one row being axially offset relative to the apertures of the other row so that the centers of one row of apertures lie along planes transverse to the tubular sleeve that are between the apertures in the other row of apertures; and first fasteners interlocking one of the upper and lower sets of tubes to one of the apertures in one row of apertures, and second fasteners locking the other set of lower and upper sets of tubes to the sleeve, wherein the distance between the upper and lower sets of tubes can be lengthened axially by moving the first fastener to a different aperture in a different row to lengthen the distance between the sets of lower and upper tubes to apply tension to the cover on the boat.

8. A tensioner for tensioning a flexible boat covering, comprising:

a set of upper tubes connected to the boat covering;

a plurality of connecting means connecting the upper tubes to the lower tubes, the connecting means having a sleeve with two adjacent rows of holes oriented along the sleeve axis and offset relative to one another in the axial direction and a slot oriented substantially perpendicular to the sleeve axis;

first fastening means for detachably fastening the lower tubes to the slots; and second fastening means for detachably fastening the upper tubes to the holes wherein the sleeve is rotatable and translatable so as to selectively engage the second fastening means with any of the holes.

* * * * *